US008267605B2

(12) United States Patent
Bouix et al.

(10) Patent No.: US 8,267,605 B2
(45) Date of Patent: Sep. 18, 2012

(54) CAPACITOR POWERED PERSONAL CARE DEVICES

(75) Inventors: Herve F. Bouix, New York, NY (US); Christophe Jacob, Saint Denis le Thiboult (FR)

(73) Assignee: ELC Management LLC, New York, NY (US)

( * ) Notice: Subject to any disclaimer, the term of this patent is extended or adjusted under 35 U.S.C. 154(b) by 0 days.

(21) Appl. No.: 13/100,806

(22) Filed: May 4, 2011

(65) Prior Publication Data

US 2011/0233184 A1 Sep. 29, 2011

Related U.S. Application Data

(63) Continuation-in-part of application No. 12/732,835, filed on Mar. 26, 2010.

(51) Int. Cl.
*A46B 11/08* (2006.01)
*A47L 13/32* (2006.01)

(52) U.S. Cl. ..... 401/1; 401/2; 401/126; 132/218

(58) Field of Classification Search ..... 401/1, 2, 401/126, 128–130, 121–122; 132/218, 318, 132/320; 219/209, 222–229; 320/166
See application file for complete search history.

(56) References Cited

U.S. PATENT DOCUMENTS

| | | | |
|---|---|---|---|
| 2,488,591 | A | 11/1949 | Fevas |
| 4,291,685 | A | 9/1981 | Taelman |
| 4,329,567 | A | 5/1982 | Kunz et al. |
| 4,465,073 | A | 8/1984 | Schwob |
| 4,538,630 | A | 9/1985 | Henderson |
| 4,733,784 | A | 3/1988 | Bennett |
| 4,889,440 | A | 12/1989 | Shano |
| 5,096,319 | A | 3/1992 | Gueret |
| 5,395,175 | A | 3/1995 | Bontoux et al. |
| 5,556,468 | A | 9/1996 | Legrain et al. |
| 5,775,344 | A | 7/1998 | Clay |
| 5,851,079 | A | 12/1998 | Horstman et al. |
| 5,853,010 | A | 12/1998 | Suh |
| 5,911,226 | A | 6/1999 | Vecchiola et al. |
| 6,009,884 | A | 1/2000 | Suh |
| 6,454,127 | B1 | 9/2002 | Suomela et al. |
| 6,508,603 | B1 | 1/2003 | Vasas |

(Continued)

FOREIGN PATENT DOCUMENTS

| | | |
|---|---|---|
| DE | 19839940 | 3/2000 |

(Continued)

OTHER PUBLICATIONS

Minco, Thermofoil Heaters (on-line), 2005 (Retrieved on Mar. 22, 2006). Retrieved from the Internet: URL: http://www.minco.com/products/heaters.aspx.

(Continued)

*Primary Examiner* — David Walczak
*Assistant Examiner* — Jennifer C Chiang
(74) *Attorney, Agent, or Firm* — Peter Giancana

(57) ABSTRACT

A handheld electronic personal care device (with or without an applicator head) comprising a fast charging capacitor, and one or more electric load elements. The device may or may not be designed for use with one or more personal care compositions. Examples of load elements include heating and cooling elements, electric motors, sound and light elements, data storage and processing elements.

15 Claims, 11 Drawing Sheets

U.S. PATENT DOCUMENTS

| | | | | |
|---|---|---|---|---|
| 6,911,010 | B2 | 6/2005 | Dirks et al. | |
| 7,083,347 | B2 | 8/2006 | Marcotte et al. | |
| 7,090,420 | B2 | 8/2006 | De La Poterie et al. | |
| 7,108,438 | B2 | 9/2006 | Fontaine | |
| 7,322,366 | B2 | 1/2008 | Cho | |
| 7,448,814 | B2 | 11/2008 | Bouix et al. | |
| 7,465,114 | B2 | 12/2008 | Kress et al. | |
| 7,661,562 | B2 | 2/2010 | Tyrrell et al. | |
| 7,669,605 | B2 | 3/2010 | Cho | |
| 7,696,728 | B2 * | 4/2010 | Cross et al. | 320/166 |
| 7,753,609 | B2 | 7/2010 | Bouix et al. | |
| 2004/0096258 | A1 | 5/2004 | Kim | |
| 2005/0013838 | A1 | 1/2005 | De La Poterie | |
| 2005/0031656 | A1 | 2/2005 | Pays et al. | |
| 2005/0244209 | A1 | 11/2005 | Gueret | |
| 2005/0258172 | A1 | 11/2005 | Gueret | |
| 2006/0032512 | A1 | 2/2006 | Kress et al. | |
| 2006/0246118 | A1 | 11/2006 | Gueret | |
| 2006/0251686 | A1 | 11/2006 | Gueret | |
| 2007/0206986 | A1 | 9/2007 | Gueret | |
| 2008/0273911 | A1 | 11/2008 | Gueret | |
| 2009/0020133 | A1 | 1/2009 | Gueret | |
| 2009/0247367 | A1 | 10/2009 | Ray | |
| 2010/0024836 | A1 * | 2/2010 | Degennes | 132/200 |
| 2010/0043817 | A1 * | 2/2010 | Haan | 132/211 |
| 2010/0054841 | A1 | 3/2010 | Cho | |
| 2010/0086507 | A1 | 4/2010 | Gueret | |
| 2011/0097133 | A1 * | 4/2011 | Duru et al. | 401/1 |
| 2012/0009002 | A1 * | 1/2012 | Lo et al. | 401/6 |

FOREIGN PATENT DOCUMENTS

| | | |
|---|---|---|
| EP | 1563760 | 8/2005 |
| FR | 2891394 | 3/2007 |
| GB | 2174896 | 11/1986 |
| WO | 2007/114551 | 10/2007 |

OTHER PUBLICATIONS

International Search Report mailed Mar. 3, 2008, of PCT/US07/69759.

Written Opinion of the ISA dated Mar. 3, 2008, of PCT/US07/69759.

Related Application: Boux and Jacob, "Heated Mascara Applicator and Suitable Compositions," U.S. Appl. No. 12/732,835, filed Mar. 26, 2010.

Related Application: Boux and Jacob, "Heated Mascara Applicator and Suitable Compositions," U.S. Appl. No. 11/422,729, filed Jun. 7, 2006.

Related Application: Boulx and Jacob, "Cosmetic Applicators Containing Heating Elements," U.S. Appl. No. 12/730,789, filed Mar. 24, 2010.

Related Application: Bouix, et al "Reuseable Pump Dispenser for Heated Personal Care Compositions," U.S. Appl. No. 12/948,840, filed Nov. 18, 2010.

Related Application: Bouix, et al., "System for Sampling a Heated Product," U.S. Appl. No. 12/980,526, filed Dec. 29, 2010.

* cited by examiner

CAPACITOR POWERED PERSONAL CARE DEVICES

The following is a continuation-in-part application of (and claims benefit of) U.S. Ser. No. 12/732,835, filed Mar. 26, 2010.

FIELD OF THE INVENTION

The present invention pertains to electronic personal care devices that power an electric load, such as a heater, cooler, motor, light source, or sound source, just to name a few. More specifically, the present invention is concerned with handheld personal care devices that can be recharged quickly, and do not require batteries.

BACKGROUND OF THE INVENTION

U.S. Pat. No. 7,465,114 and U.S. Ser. No. 12/732,835 exemplify recent advances in handheld electronic personal care devices. The adaptation of printed circuit board technology has overcome the problems of personal care devices implemented with conventional electronics. Conventional electronic personal care devices utilize flexible metallic wiring and contacts for conducting electricity from a power source to a switch, then to a load element (i.e. motor or heater) and possibly to one or more light indicators and load controls, before returning to the power source. If more than one independent circuit is required, then the number of wires and electrical connections increases proportionately. In contrast, U.S. Pat. No. 7,465,114 and U.S. Ser. No. 12/732,835 describe electronic applicators that do not use metal wire conductors or use substantially fewer, do not have the space constraints associated with using wire circuitry, substantially reduce the labor required to assemble an applicator, have more reliable electrical connections and sophisticated electrical options, and reduced circuit length. However, like most electronic personal care devices to date, U.S. Pat. No. 7,465,114 and U.S. Ser. No. 12/732,835 use batteries to power their respective electric loads. A main focus has been stretching battery life by improving circuit efficiency, in the hopes of getting hours of use before having to change or recharge the battery. To the best of our knowledge, the prior art does not appear to contemplate the benefits of personal care applicators that must be recharged after just several minutes of use. Specifically, to the best of our knowledge the prior art does not contemplate that many personal care devices could be implemented with a fast charging capacitor as the primary power source, no batteries being required.

OBJECTIVES

The term "objective" does not, by itself, make a feature essential.

A main objective of the present invention is to provide a novel platform for implementing all manner of electronic handheld personal care devices. This implementation does not require batteries, but makes use of fast charging capacitors. Such devices may be implemented as vibrating mascara applicators, rotating mascara applicators, heated mascara applicators, heated lip gloss applicators, heated acne pens, heating or cooling treatment applicators, devices that produce light and/or sound, just to name a few.

SUMMARY OF THE INVENTION

Figure 1:
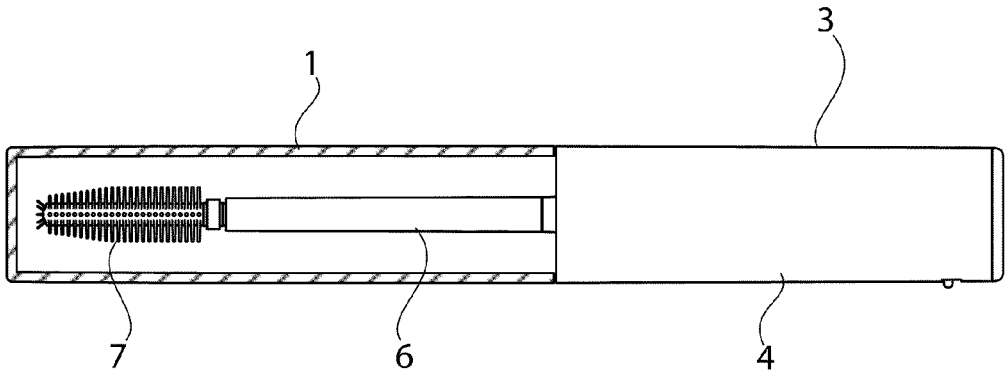
FIG. 1 shows one embodiment of heated mascara applicator according to the present invention, wherein the container (1) is shown in cross section.

This summary is provided merely as an introduction, and does not, by itself, limit the appended claims.

Generally, the present invention is a handheld electronic personal care device (with or without an applicator head) comprising a fast charging capacitor, and one or more electric load elements. The device may or may not be designed for use with one or more personal care compositions.

According to one aspect, the present invention is a handheld electronic applicator comprising an applicator head, a source of electric current that may be recharged quickly, and one or more electric load elements. Examples of load elements include heating and cooling elements, electric motors, sound and light elements, data storage and processing elements.

According to another aspect, the present invention is a kit comprising an electronic personal care device that comprises a fast charging capacitor, wherein the device has a well defined or intended use. The capacitor energy is sufficient for completing no more than a limited number of intended uses, for example, no more than 10 uses, or no more than 5 uses, or no more than 2 uses, or no more than exactly 1 use.

According to another aspect, the present invention is a kit as just defined, further comprising a set of low dose containers that hold no more than a limited number of doses of product. Preferably, the number of intended uses that may be completed by a fully charged capacitor, is coordinated with the number of doses in each container. For example, the device is a vibrating lipstick applicator, the intended use is applying lipstick to two lips (one set of lips), each container holds enough product for completing exactly 2 applications to a set of lips, and will be discarded thereafter; the capacitor is fully charged with enough energy to complete 4 lipstick applications, but not more. In this example, after a user has gone through 2 containers of lipstick (i.e. applied lipstick 4 times), she will have to recharge the device. Or, for example, the device is a heating mascara applicator, the intended use is applying mascara to the eyelashes of two eyes; each container holds enough product for completing exactly 2 applications of two eyes, and will be discarded thereafter; the capacitor is fully charged with enough energy to complete 1 heated mascara application, but not more. In this example, two full charges of the capacitor are required to go through 1 container of mascara.

DETAILED DESCRIPTION

Definitions

"Handheld device" means a device that is intended to be held in one or more hands and raised in the air, as the device is performing one or more main activities. For example, a main activity may be loading product onto a device and delivering product to an application surface. Thus, "handheld" means more than just being able to grasp an object. For example, a "space heater" does not meet this definition of handheld. "Device" may also encompass more than product applicators; devices that produce light or sound or heat or coolness, for example.

Throughout the specification "personal care" can mean cosmetic, dermatologic or pharmaceutical.

Throughout the specification "device" may include "applicator" within its meaning.

Throughout the specification "comprise" means that an element or group of elements is not automatically limited to those elements specifically recited, and may or may not include additional elements.

Throughout the specification, "electrical contact" means (a.) that a current is able to flow between electronic elements, whether there is direct physical contact between the elements or whether one or more other electronic elements intervene, or (b.) a current is induced a first electronic element as a result of the electric and/or magnetic fields of a second electronic element.

Various features of some of the embodiments will now be described. Certain described features may be used separately or in combination with other described or implied features. Some of the embodiments may use only one or more described features. Some embodiments of the present invention include heated mascara applicators. Although the principles described herein are more broadly applicable, the principles will be described in relation to heated mascara applicators, mascara and mascara application.

Heated Applicator Overview

One embodiment of a heating applicator according to the present invention is shown in FIG. 1, with a product container . The applicator (3) comprises an elongated structure comprising a proximal end and a distal end. Toward the proximal end is a handle (4) for grasping by a user, which also serves as a housing for a source (5) of electric current and some associated circuitry. Attached to the handle and moving toward the distal end of the applicator is a hollow stem (6). Further toward the distal end, is an applicator head (7), shown in the figures as a molded brush. The applicator head is able to be inserted into a container (1) that contains a product. The bulk of the electronic circuitry is carried on a printed circuit board (PCB) (8), including specifically, the heat generating elements. The PCB is an elongated structure that passes through the stem, from the electric current source (closer to the proximal end of the applicator) to the applicator head (nearer the distal end of the applicator).

The Container

The container (1) is able to hold an amount of a personal care product that can be withdrawn by a consumer. The container may range from a full size container, typically intended for individual retail sale, down to single dose size, which may be used for free samples or sold in a set of several containers. The container is able to receive into itself a heating applicator, which is used to withdraw product from the container. The container may comprise a wiper (1*a*, see FIG. 10*b*) and a neck finish that is able to receive a closure in a sealing engagement. For example, the neck may have threads (1*b*). While this heating mascara embodiment is described as comprising a container, other embodiments of the invention may not comprise a container.

The Handle

Figure 2B:
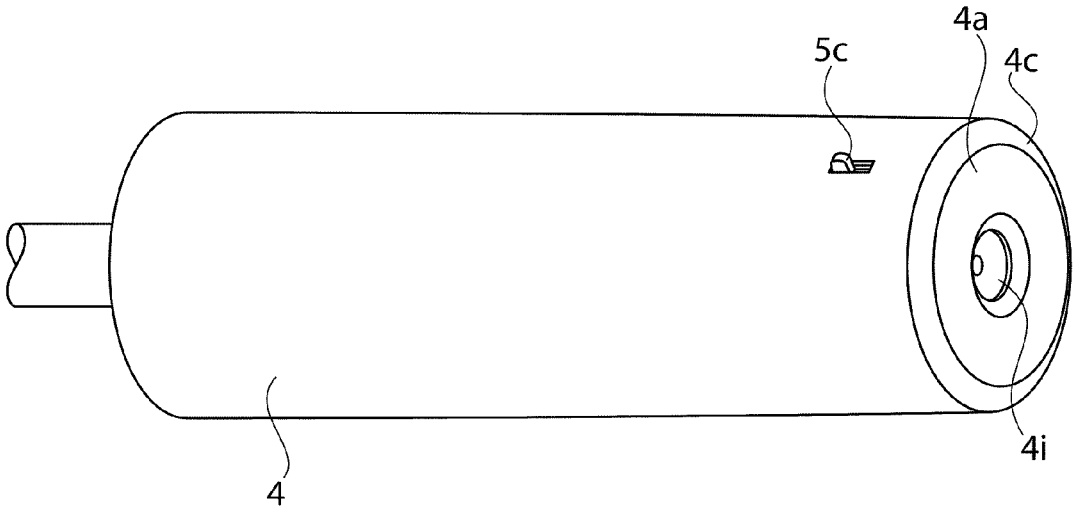
FIG. 2*b* is a perspective view of the handle, showing the proximal end thereof.
Figure 2A:
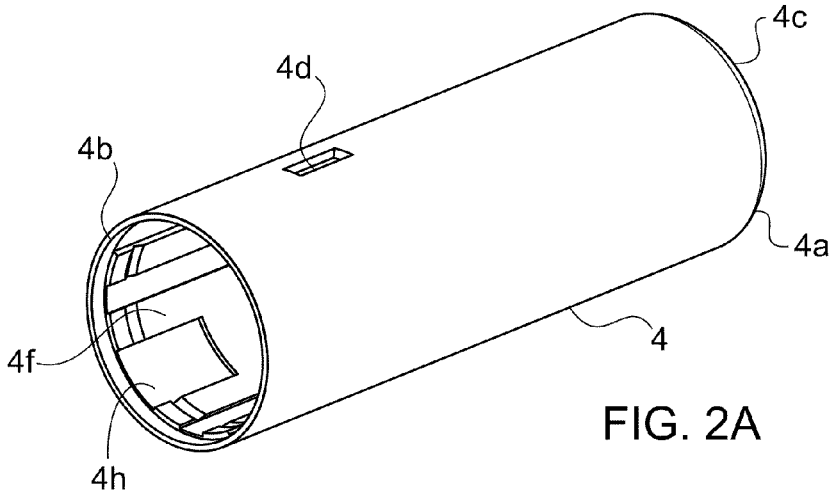
FIG. 2*a* is a perspective view a handle, showing the distal end thereof.

In FIGS. 1, 2*a* and 2*b*, the handle (4) is shown as a hollow cylindrical structure, but the shape may vary. The handle has a distal end (4*b*) that is closer to the applicator head (7) and a proximal end (4*a*) that is further from the applicator head. The handle is large enough to be grasped by a user of mascara products, as is typically done in the field. For example, the handle may be from 25 mm to 150 mm in length and from 12 mm to 50 mm in diameter. The proximal end (4*a*) of the handle has a port opening (4*i*). The port opening provides access to an electrical connector (5*d*) inside the handle. The distal end of the handle is generally opened, and the stem (6) of the applicator extends beyond the distal end. The proximal end of the handle may be removable. For example, the distal end may comprise or be formed as a cap (4*c*). The removable cap offers access to the interior of the handle. The handle may be of the type that is designed to act as a closure for the container (1), especially through cooperating threads. The handle may have a window (4*d*), through which a light emitting diode (LED) element may shine. At an outer surface of the handle, one or more electric switches may be accessible to a user. For example, the switch (5*c*) may open and/or close one or more electric circuits, such as a heating circuit that includes the current source or a recharging circuit that includes a power reservoir.

Figure 8:
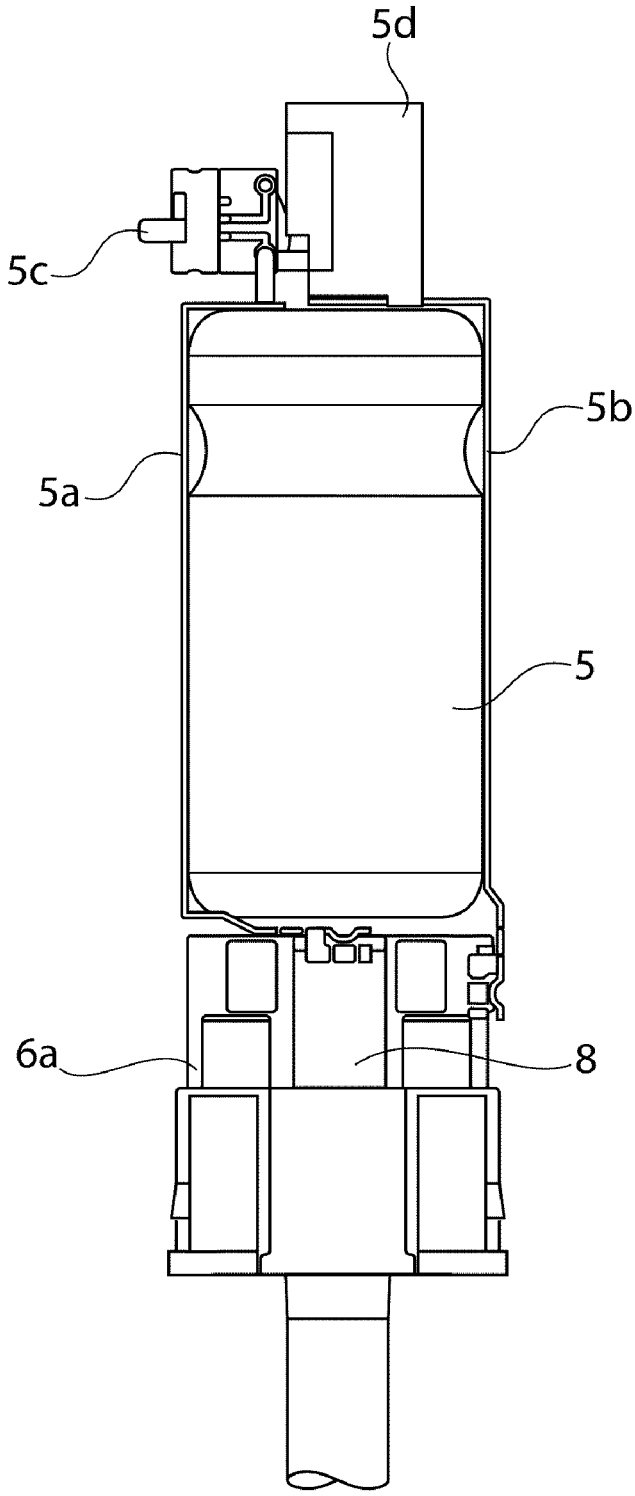
FIG. 8 shows a number of components that may typically be housed inside the handle.
Figure 9:
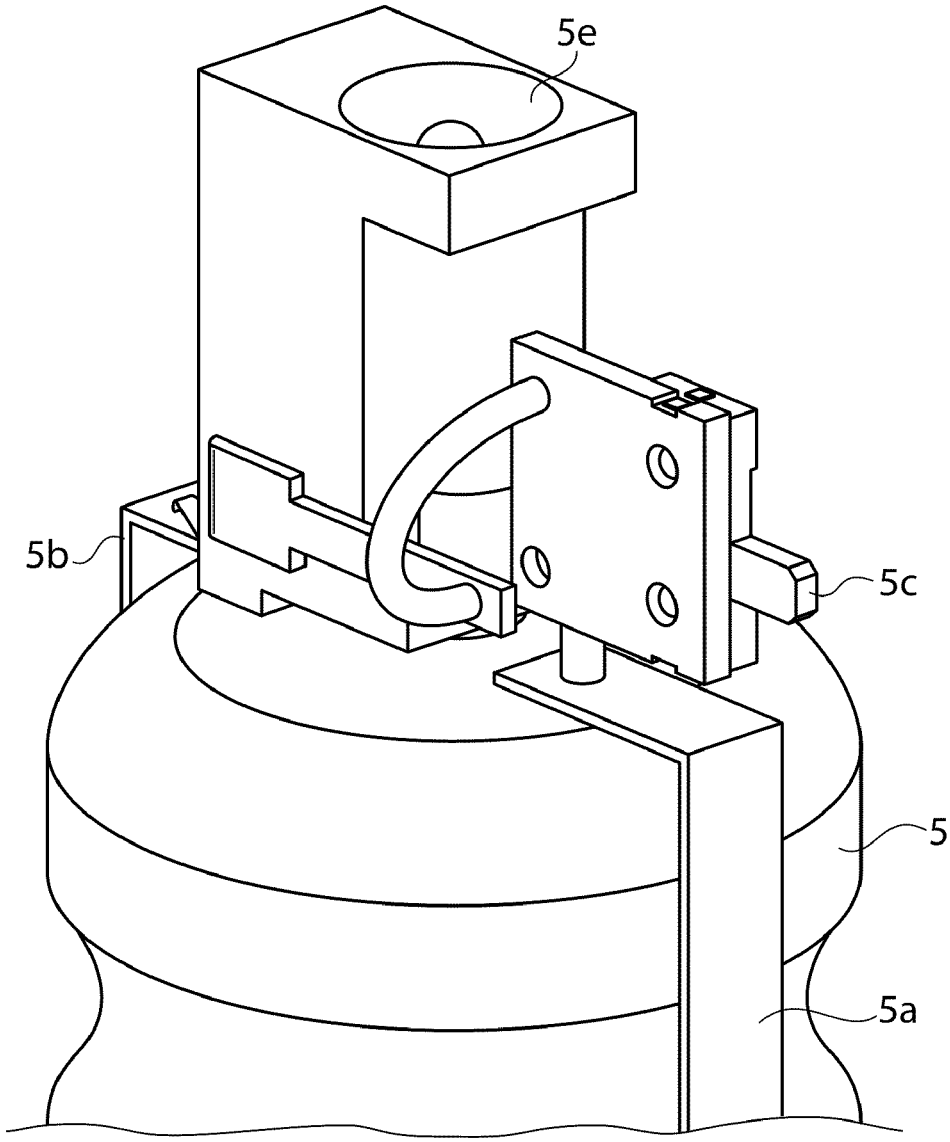
FIG. 9 shows the top of the capacitor fitted with a female-type electrical connector.

The interior of the handle (4) is sufficiently large to accommodate a current source, such as one or more capacitors (5), a portion of a PCB (8), and a portion of the hollow stem (6), and one or more metallic leads that create afferent and/or efferent paths to the PCB. FIG. 8 shows some of the components that may typically be housed in the handle.

Fitted to the handle, and extending toward the distal end of the applicator, is a stem (6). The stem and the handle may be fitted with one or more of: an interference fit, a catch mechanism, adhesive, or any suitable means, depending on the nature of the connection, to be discussed below.

The Stem

Figure 3A:
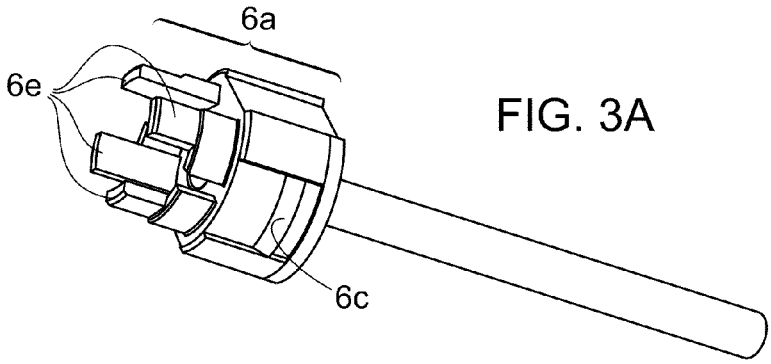
FIGS. 3*a* and 3*b* depict a stem according to the present invention.
Figure 3B:
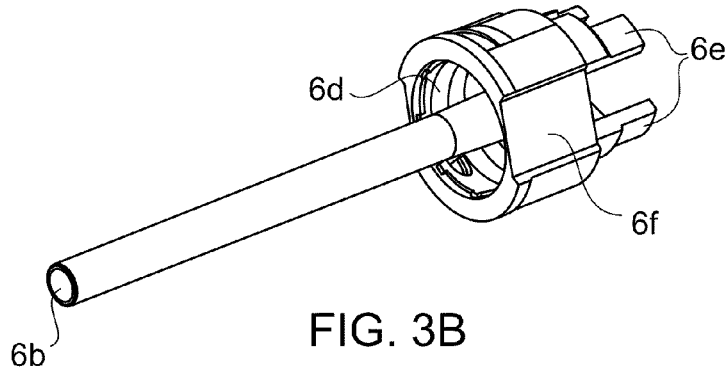

One embodiment of a stem (6) is shown in FIGS. 3*a* and 3*b*. The stem is a hollow, elongated member. A proximal end (6*a*) of the stem is fitted to the handle (4). The stem and the handle may be fitted with one or more of: an interference fit, a catch mechanism, adhesive or any suitable means. For example, when assembled, one or more raised beads on the stem (6*c* in FIG. 3*a*) are forced into the handle until the raised bead of the stem encounters a depression on the inner surface of the handle (4*h* in FIG. 2*a*). The raised bead of the stem expands into the depression of the handle, such that the stem cannot ordinarily be removed from the handle, through an intended use of the applicator (3). In a preferred embodiment, the handle and stem are attached permanently or semi-permanently, which means that a consumer may not easily separate the stem and handle. This arrangement is convenient when the current source is not intended to be replaced. In this case, the capacitor may be assembled into the handle before the assembly operation of the handle and stem.

The stem is hollow, and opened at its proximal and distal ends to permit the printed circuit board (8) to be reposed through it, with portions of the printed circuit board emerging from both ends of the stem. The stem may be of a type that is designed to act as a closure for the container (1), especially through cooperating threads (6*d*) which interact with container threads (1*b*). The distal end (6*b*) of the stem may attach to a portion of the applicator head (7).

The Printed Circuit Board

Figure 5A:
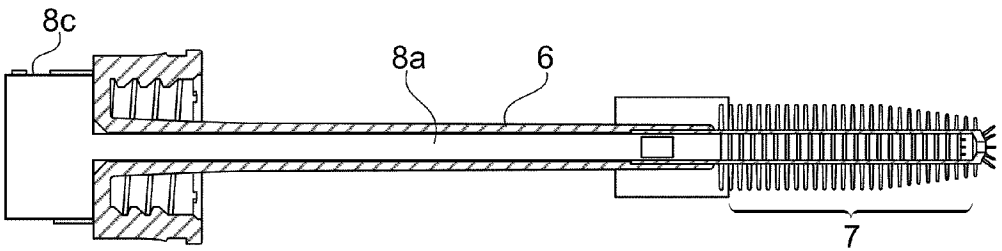
FIGS. 5*a* and 5*b* show a printed circuit board and its relationship to the stem and applicator head.
Figure 5B:
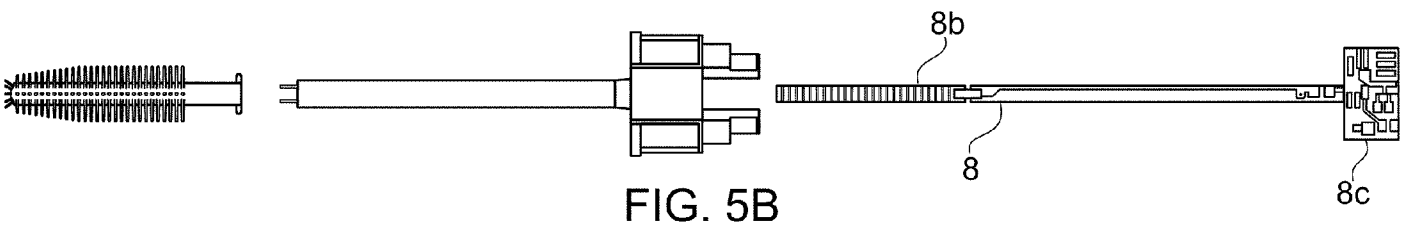

Referring to FIGS. 5*a* and 5*b*, the printed circuit board (PCB) (8) is an elongated structure that passes through the stem (6), from the capacitor (5) to the applicator head (7). The printed circuit board comprises a substrate (8*a*) that is non-conductive to electricity. Suitable substrate materials include, but are not limited to, epoxy resin, glass epoxy, Bakelite (a thermosetting phenol formaldehyde resin),a and fiberglass. The substrate may be about 0.25 to 5.0 mm thick, preferably 0.5 to 3 mm, more preferably, 0.75 to 1.5 mm thick. Portions of one or both sides of the substrate may be covered with a layer of copper, for example, about 35 μm thick.

The substrate supports a heat generating portion (8*b*), electronic components and conductive elements. Among the conductive elements supported by the PCB, are electrical leads and/or terminals that that are effective to connect the PCB to a current source, such as a capacitor (5).

The applicator comprises a switchable circuit that includes the heat generating portion (8*b*). This switchable circuit is formed by the articles on the PCB (i.e. conductive elements, electronic components and the heat generating portion) in combination with a capacitor, and a switching mechanism. This circuit may include other elements, as well. When this switch is closed, current is flowing to the heat generating portion, and this defines the heat generating portion as "on". When this switch is opened, current is not flowing to the heat generating portion, and this defines the heat generating portion as "off". The applicator may comprise other circuits as well, which may draw power from the capacitor (5), or from some other power source (i.e. a battery or another capacitor).

Figure 6:
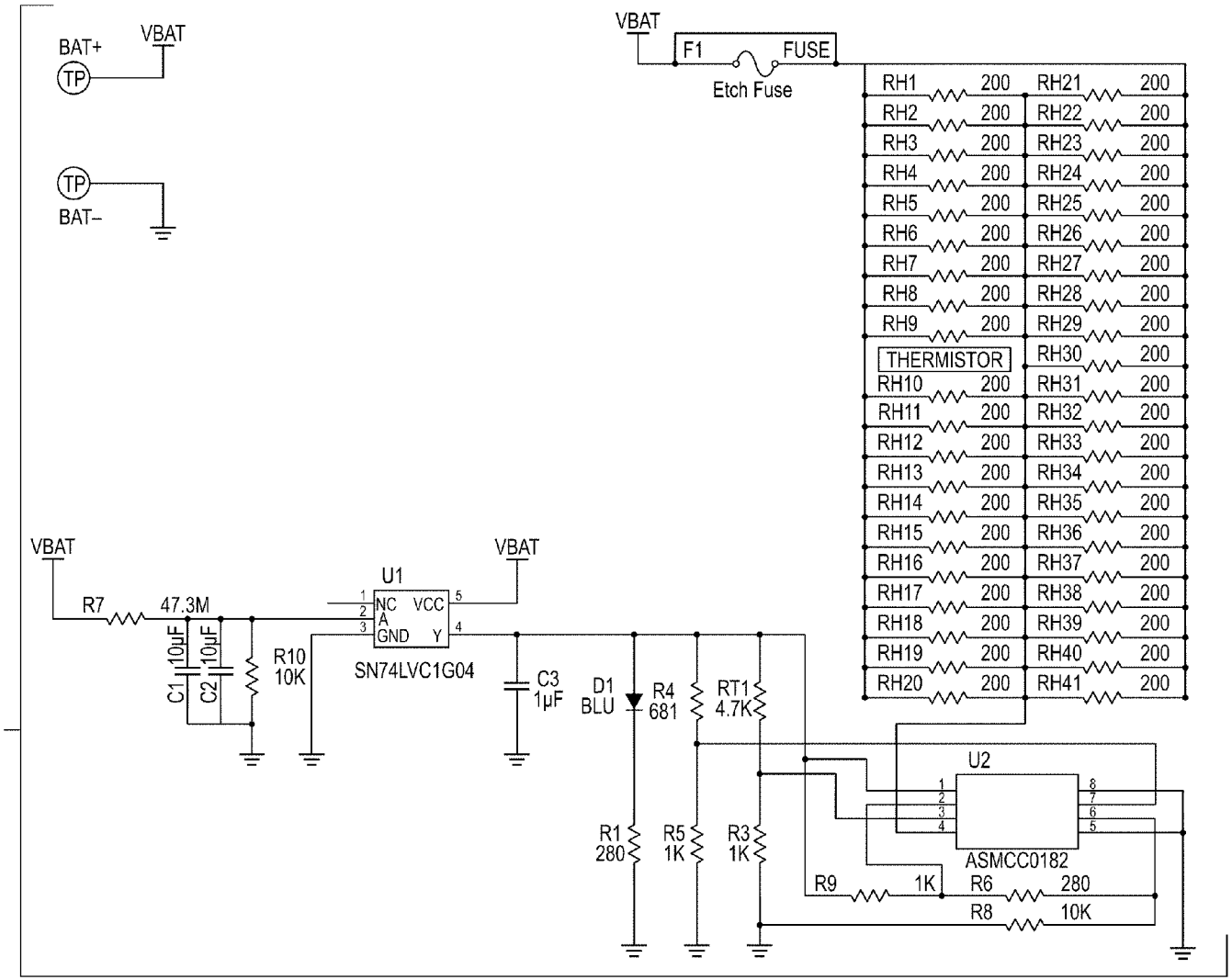
FIG. 6 is a schematic of one possible electronic circuit used in the present invention.
Figure 7:
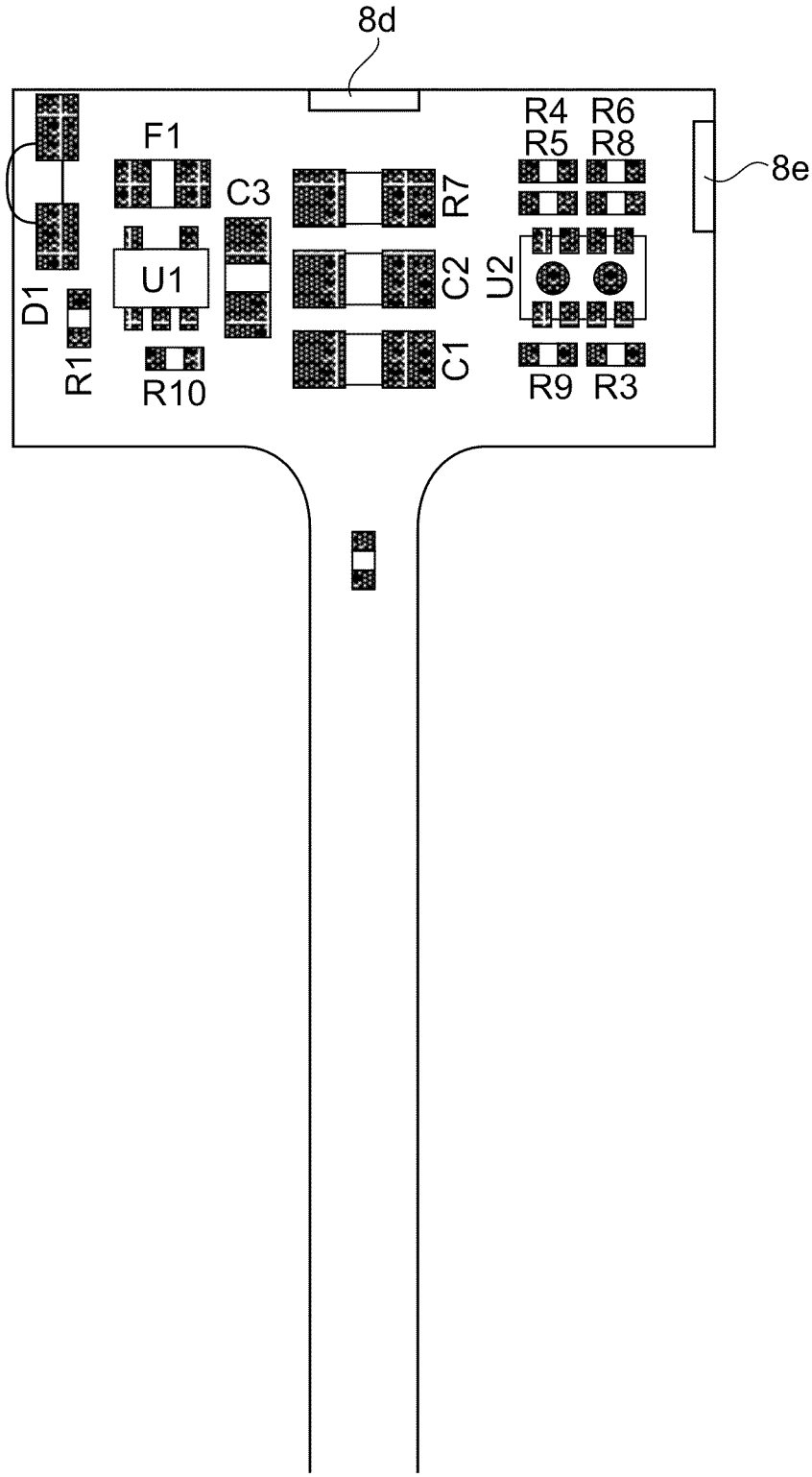
FIG. 7 shows one possible electronic circuit laid out on a printed circuit board.

The printed circuit board may have various electronic elements. As an example, a printed circuit board will be described that supports various elements in a preferred (but not exclusive) arrangement. FIG. 6 shows one possible switchable, electronic circuit laid out on a printed circuit board (8). FIG. 7 shows one possible layout of electronic elements on the PCB. Electric current from the capacitor (5) enters the printed circuit board at a PCB terminal (8*d*). This terminal may occupy an edge of the enlarged portion (8*c*) of the PCB. Resistor R7 and parallel capacitors C1 and C2, interact with a power inverter U1, to automatically shut off current to the heat generating portion when capacitors C1 and C2 are full. The capacitors may be, for example, ceramic chip capacitors, fastened to or otherwise associated with the PCB. The rated capacitances are chosen to control the length of time from when the switchable circuit is first closed to when the switchable circuit (and heat generating portion) will automatically turn off. For example, the heat generating portion may automatically turn off after about 2 to 2.5 minutes or after about 2 to 3 minutes of use, as desired. This overhead timer, automatic shut off feature is optional, and prevents the capacitor from running down if the user fails to turn off the circuit. Depending on the level of sophistication employed, an overhead timer, such as the capacitor-based one shown in FIG. 6, may require a reset period, following an automatic shut off, in which the heating generating portion (8*b*) cannot be activated (i.e. cannot be "turned on"). The reset time, which may be several seconds, allows capacitors C1 and C2 to discharge.

Optionally, an NTC thermistor may be located in close proximity to the heat generating portion (8*b*). For example, in the circuit diagram of FIG. 6, a space is shown between heating elements RH9 and RH10. The NTC thermistor may be located in that space, or any space where it could detect slight variations in the ambient temperature of the space surrounding the heating elements. The NTC thermistor and a fixed value resistor R3, are configured as a voltage divider circuit that creates a voltage level that is proportional to and/or varies with the temperature of the heat generating portion. That voltage level is monitored by an operational amplifier and is passed to the operational amplifier at the inverting input (pin 3 of U2). A threshold reference voltage is produced by another voltage divider circuit at R4 and R5, and this voltage is connected to the non-inverting input (pin 7 of U2) of the operational amplifier. In this way, the operational amplifier is used as a voltage comparator. When the output voltage of the voltage divider circuit that includes the negative temperature thermistor crosses the reference voltage (either rising above or falling below), then the output of the operational amplifier (pin 2 on U2) changes state. The output of the op amp is passed to an N-channel MOSFET switch (at pin 6 of U2), and is used to control the state of the MOSFET switch. When the MOSFET switch is closed, current flows from the switch (at pin 4 of U2) to the heat generating portion (8*b*). When the switch is opened, current cannot flow to the heat generating portion. An edge of the enlarged portion (8*c*) of the PCB (8) is provided with a second terminal (8*e*), which leads to the through conductor (5*b*), back toward the capacitor (5).

The switchable circuit may further include noise reducing components, such as capacitor C3, an on/off indicator, such as LED D1, and multiple fused portions, such as at F1. Also, more than 1 thermistor can be used to increase the temperature monitoring capabilities.

The switchable circuit, as described, includes a system that actively measures the output temperature and adjusts itself to meet a desired temperature. A heating applicator that includes this circuit can stay for extended periods (for example, the life of the power source) holding a desired temperature, with little concern for overheating. Also, through the use of an automatic shut off and through the monitoring of the temperature of the heat generating portion, power utilization is significantly reduced. In this regard, the present invention may provide a commercially feasible heated mascara applicator with a level of precision and reliability described herein.

The circuit may further include a system for monitoring and maintaining an output voltage of the capacitor. Preferably, the circuit includes a system that monitors and adjusts, as needed, the output capacitor voltage, to maintain a narrow range. One benefit of such a system is improved consistency in applicator performance and improved predictability between capacitor rechargings.

All of the electronic elements or components except the resistive heating element(s) (8*b*) may be located on an enlarged portion (8*c*) of the printed circuit board (8), near the proximal end of the board. The PCB itself may have any shape or dimensions that are convenient to manufacture and assemble into the stem (6) and applicator. For example, the PCB may have an overall length that extends from the capacitor (5) to the applicator head (7). This length depends on the overall length and design of the applicator, but may often be 30 mm to 150 mm, more preferably, 50 to 120 mm, even more preferably 75 to 100 mm. The largest lateral dimension of the enlarged portion (8*c*) must be less than the interior dimension of that part of the applicator in which it resides. For example, in the figures, the enlarged portion of he PCB resides in the handle. Therefore, the lateral dimensions of the enlarged portion should not exceed the interior diameter of the handle. For example, the handle may be about 12 mm to 50 mm in diameter, for many applications.

The circuit described above utilizes a printed circuit board to form an electronic circuit subassembly that can be inserted into the hollow stem(6) and connected to a current source. This electronic circuit subassembly is not dependent on the hollow stem for its structural integrity, nor for its electrical operation. The use of a printed circuit subassembly may result in a cost savings, and error reduction in manufacture. Thus, the circuit herein described may provide a truly effective, commercially feasible, aesthetically acceptable, capacitor powered, heated mascara applicator, with the performance, reliability and convenience herein described, and may well achieve a cost savings and error reduction in manufacturing.

The Applicator Head

Figure 4:
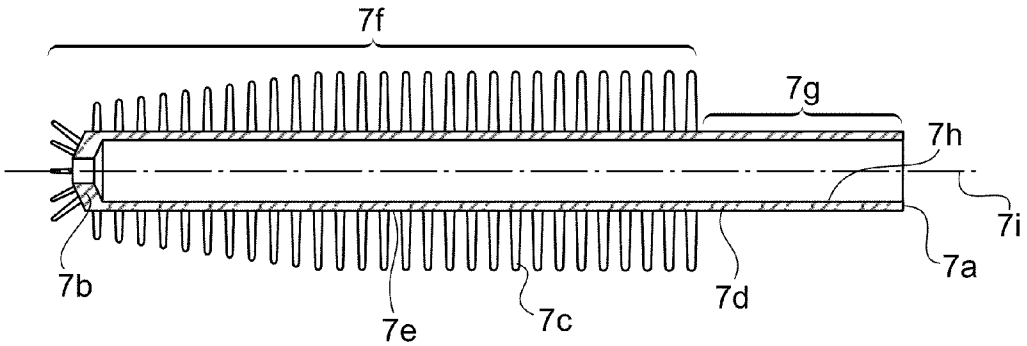
FIG. 4 depicts a molded applicator head.

The applicator head (7) is that part of the device that is used to take product from the container (1) and deliver it to an application surface, such as the eyelashes. The applicator head may have an outer surface (7*e*) on which the product sits before being deposited on the application surface. The applicator head may also perform one or more other functions, such as grooming the eyelashes. When the device is a mascara applicator, then in a preferred embodiment, the applicator head includes a molded brush. An example of a molded brush is shown in FIG. 4. The brush is fashioned as an elastomeric member comprising a hollow sleeve (7*d*), having an opened, proximal end (7*a*), an opened or closed distal end (7*b*), and a plurality of bristles (7*c*) projecting from an outer surface (7*e*) of the hollow sleeve. More specifically, the bristles project from a portion (7*f*) of the outer surface. The bristles may be arranged over substantially all of the outer surface (except for the space between bristles), or there may be another portion (7*g*) of the outer surface without any bristles.

The proximal end of the hollow sleeve (7*d*) may attach to the distal end (6*b*) of the stem (6), either by receiving a portion of the stem into the hollow sleeve, or by the proximal end of the applicator head being received into the hollow stem. However, this attachment may not be necessary, because the molded, hollow sleeve is able to receive a distal end of the printed circuit board (8) that is emerging from the distal end of the stem. The applicator head is closely associated with the heat generating portion. For example, preferably, the hollow sleeve fits snugly over that part of the distal end of the printed circuit board that comprises the heat generating portion. Most preferably, this fit is sufficiently snug to prevent the sleeve from coming off the PCB in normal handling and use. Furthermore, a snug fit of the hollow sleeve on the PCB, improves the efficiency of heat transfer through the sleeve, from the inside, going out, while gaps between the heat generating portion (8*b*) on the printed circuit board and the hollow sleeve, decrease heat transfer efficiency. Therefore, it is preferable if there are as few gaps as possible between the heat generating portion and the inner surface (7*h*) of hollow sleeve. It is most preferable if there are no such gaps.

In one embodiment of the present invention, the heat generating portion (8*b*) on the printed circuit board (8) is in direct contact with an inner surface (7*h*) of the hollow sleeve (7*d*) of a molded applicator head (7). This arrangement is effective, but still may leave air-filled gaps underneath the hollow sleeve, within the heat generating portion, for example. The transfer of heat through the hollow sleeve and into a product on the outer surface of the applicator head may be diminished by these air-filled gaps. Another embodiment of the present invention includes embedding the heat generating portion in a continuous mass of a heat transfer material. The material may be applied by dipping the distal end of the PCB in heat transfer material that is in a softened state. When the material hardens, there may be virtually no air gaps within the heat generating portion. In at least some embodiments, as long as the heat transfer material improves the rate of heat transfer from the heat generating portion through the hollow sleeve, then this embodiment is preferred for many applications. The heat transfer material can form a semi-hardened or hardened cylindrical shell over the distal end of the PCB. The cylindrical shell fits snugly into the cylindrical hollow sleeve. In this way, substantially all of the inner surface of the hollow sleeve may be in direct contact with the heat transfer material that encases the heat generating portion, and the transfer of heat through the hollow sleeve and into a product is improved. Another advantage of the cylindrical shell is that it may make it easier to slide the sleeve onto the PCB, because the shell provides a smooth, uniform surface compared to the PCB without the heat transfer material. Examples of useful materials for the cylindrical shell of heat transfer material include one or more thermally conductive adhesives, one or more thermally conductive encapsulating epoxies or a combination of these. An example of a thermally conductive adhesive is Dow Corning® 1-4173 (treated aluminum oxide and dimethyl, methylhydrogen siloxane; thermal conductivity=1.9 W/m·K; shore hardness 92A). An example of a thermally conductive encapsulating epoxy is 832-TC (a combination of alumina and a reaction product of epichlorohydrin and Biphenyl F; available from MG Chemicals, Burlington, Ontario; thermal conductivity=0.682 W/m·K; Shore hardness 82D). For many applications, a higher thermal conductivity is preferred over a lower thermal conductivity.

Various parameters of the applicator head (7), will affect the amount of heat required to raise the temperature of a product disposed on the bristles, and/or the amount of time required to do it. For example, in general the more bristles (7*c*) present or the larger the bristles, the more heat will be needed to raise the temperature of the product on the bristles, in a given amount of time. This is true because there is more bristle mass being heated, and because there is more product than would be the case if fewer or smaller bristles were present. Also, for example, given a specific rate of heat generation, a thicker sleeve (7*d*) means more time will be needed to raise the temperature of the product on the bristles. This is so because there is more sleeve mass being heated, than if a thinner sleeve was used. To increase the rate of heat transfer through the molded applicator sleeve, and to reduce the amount of heat lost, it may be preferable to make the molded sleeve as thin as possible, considering the limitations of molding in the specific material used. Preferably, the sleeve thickness is less than 1.0 mm, more preferably less than 0.8 mm, even more preferably less than 0.6 mm and most preferably less than 0.4 mm.

Of course, since heat passes through the sleeve and bristles, the amount of heat and/or the length of time needed to raise the temperature of a product disposed on the applicator head, also depends on the thermal conductivity of the material(s). So, in general, to decrease the amount of time required to raise the temperature of the product, one might increase the rate of heat generation, decrease the mass being in heated (applicator head and/or product), and/or increase the thermal conductivity of the applicator head. One might consider reducing the size and mass of the bristles, but that decision should be made with regard to applicator performance in grooming the lashes.

Examples of useful materials for the molded applicator head (7) include plastics, elastomers, or materials characterized by dipole bond crosslinking or hydrogen bond crosslinking, such as thermoplastic elastomers. A thermoplastic elastomer or a combination of more than one thermoplastic elastomer is preferred. In general, the nature of thermoplastic elastomers is such that articles can be consistently manufactured with relatively little variation from batch to batch, by extrusion molding, injection molding, blow molding, thermoforming, heat welding, calendaring, rotational molding, and meltcasting. One definition of thermoplastic elastomer includes the following necessary characteristics: the ability to be stretched to moderate elongations and, upon the removal of stress, return to something close to its original shape; be processable as a melt at elevated temperature; and the absence of significant creep. Examples of suitable thermoplastic elastomers include the following: styrenic block copolymers, polyolefin blends, elastomeric alloys (TPE-v or TPV), thermoplastic polyurethanes, thermoplastic copolyester, and thermoplastic polyamides. Examples of block copolymer TPEs include: Styroflex (BASF), Kraton (Shell chemicals), Pellethane (Dow chemical), Pebax, Arnitel (DSM), and Hytrel (Du Pont). Elastomeric alloys include: Dryflex (VTC TPE Group), Santoprene (Monsanto Company), Geolast (Monsanto), Sarlink (DSM), Forprene (So.F.Ter. S.p.a.), Alcryn (Du Pont), and Evoprene (AlphaGary). Some thermoplastic elastomers have crystalline domains where one kind of block co-crystallizes with another block in one or more adjacent chains. The relatively high melting temperature of the resulting crystal structure, tends to make the domains more stable than they otherwise would be. The specific crystal melting temperature determines the processing temperatures needed to shape the material, as well as the ultimate service use temperatures of the product. Examples of such materials include Hytrel® (a polyester-polyether copolymer) and Pebax® (a nylon or polyamide-polyether block copolymer). For the molded applicator head of the applicator of FIG. 1, Hytrel® and Pebax® are useful in particular embodiments.

Materials for the applicator head, such as thermoplastic elastomers, may be useful in a range of hardness. For example, a Shore D hardness of about 25 to about 82 is preferred for many applications. More preferred are materials having a Shore D hardness of 30 to 72. Even more preferred are materials having a Shore D hardness of 47 to 55.

Optionally, a portion of the applicator head may comprise one or more thermochromic materials. Thermochromic materials change color in predictable ways, when heated. The purpose of the thermochromic material is to provide a visual notice to a user, that the applicator has achieved a certain temperature. Preferably, the portion of the applicator that comprises a thermochromic material, is easily visible to a user during normal use of a mascara applicator. For example, preferably, at least some portion of the thermochromic material will not be covered by mascara, thereby obscuring the color change.

We have described a molded bristle applicator head. However, without departing from the spirit of the invention, the applicator head may be anything that is suitable to take up product from a reservoir and transfer it to an application surface, and that conducts heat from the heat generating portion (8*b*) to the product. For example, the applicator head may be a doe-footed applicator for lip gloss or other product for application to a keratinic surface (see FIG. 11).

Heating Elements

A preferred embodiment of the heat generating portion (8*b*) comprises a plurality of individual, discrete resistive heating elements, located near the distal end of the printed circuit board, underneath the applicator head (7). Preferably, the heating elements are located only under that portion (7*f*) of the applicator head that has bristles, and not under that portion (7*g*) that does not have bristles, so as to minimize wasted heat energy. A preferred embodiment of the discrete resistive heating elements is a bank of fixed value resistors electronically arranged in series, parallel, or any combination thereof, and physically situated in two rows, one on either side of the PCB. The number of resistors and their rated resistance is governed, in part, by the requirements of heat generation of the circuit. In one embodiment, 41 discrete resistors of 5 ohms are uniformly spaced, 20 on one side of the PCB, and 21 on the other side, underneath the entire length of that portion (7*f*) of a molded applicator head that has bristles. In another embodiment, 23 6-ohm resistors are used, 11 on one side of the PCB, 12 on the other. In still another working model, forty-one 3-ohm resistors are used, 20 on one side, 21 on the other. The side with 1 fewer resistor leaves a space for a thermistor. Typically, the applicator of FIG. 1 might use individual resistive elements having rated resistances from 1 to 10 ohms. However, this range may be exceeded as the situation demands. Typically, the overall resistance of all the heating elements might range from 1 to 10 ohms. However, this range may be exceeded as the situation demands.

One preferred type of resistive heating element is a metal oxide thick film resistor. These are available in more than one form. One preferred form is a chip resistor, which is thick film resistor reposed on a solid ceramic substrate and provided with electrical contacts and protective coatings. Geometrically, each chip may be approximately a solid rectangle. Such heating elements are commercially available, in a range of sizes. For example, KOA Speer Electronics, Inc (Bradford, Pa.) offers general purpose thick film chip resistors, the largest dimension of which is on the order of 0.5 mm or less. By using resistors whose largest dimension is about 2.0 mm or less, better, in one embodiment 1.0 mm or less, even better, in another embodiment 0.5 m or less, the resistors can easily be arranged with regard to the number of rows/turns of bristles. In general, the size resistor used might be related to the pitch of the bristle turns (or spacing between rows of bristles). In one embodiment, this might be about 2 mm, but if the pitch is larger or smaller, then it may be advantageous to use larger or smaller resistors.

Typically, chip resistors may be attached to the PCB by known methods. A more preferred form of metal oxide thick film resistor, is available as a silk screened deposit. Without a housing, such as the chip resistor, the metal oxide film is deposited directly onto the printed circuit board, using printing techniques. This is more efficient and flexible from a manufacturing point of view than welding chip resistors. The metal oxide film may be deposited on the PCB as one continuous heating element, or it may be printed as individual dots. For reasons discussed above, the discrete dots may be preferred to the continuous deposit. Various metal oxides may be used in thick film resistor manufacture. One preferred material is ruthenium oxide ($RuO_2$). The individual dots may be printed as small as about 2.0 mm or less, more preferably 1.0 mm or less, most preferably 0.5 mm or less, and their thickness may vary. In fact, by controlling the size of the dots, one may alter the resistance of each dot. Also, the resistance of the thick film resistor, whether in a chip resistor or silk screened form, may also be controlled by additives in the metal oxide film. Typically, chip resistors and silk screened metal oxide dots of the type described herein, may have a rated resistance of 1 to 10 ohms.

A printed circuit board that carries silk screened thick film resistors or chip resistors, is less bulky than one that carries prior art heating elements such as a wire coil. This enables the diameter of the applicator sleeve to be smaller than other devices. The smaller diameter means that the flux of heat into the product is increased, and less heat is wasted heating the sleeve.

Furthermore, the benefits of using of a plurality of discrete heating elements that are arranged with regard to the linear distribution of the bristles was discussed at length in U.S. Ser. No. 12/732,835.

The Current Source

The applicator of FIG. 1 further comprises a source (5) of electric current, preferably a DC power supply, that is fast charging. By "fast charging" we mean that the current source is able to be fully recharged in 5 minutes or less, preferably 3 minutes or less, more preferably 2 minutes or less, and even more preferably one minute or less. "Fully recharged" means that the current source will not store any additional power. The rate of recharging depends on the power reservoir used to recharge. These charging times refer to external power reservoirs to which a typical personal care consumer would have access, such as ordinary household current, and commercially available batteries. Preferably, the fast charging current source is housed within the interior of the handle (4), which is sufficiently large to accommodate it.

The current source has at least one positive terminal and at least one negative terminal, the terminals forming part of an afferent path (going away from the current source) and efferent path (going toward the current source), respectively. One or more of the power source terminals may directly contact a conductive element on the printed circuit board (8), or one or more electrical leads may intervene, like conductors (5*a*) and (5*b*).

In a preferred embodiment, the current source includes one or more fast charging capacitors having positive and negative contacts that are accessible near a surface of the capacitor. An electrical conductor, such as metallic lead (5*a*), is able to carry electrical current from the capacitor to the printed circuit board (8). An electrical conductor, such as metallic lead (5*b*), is able to carry electrical current away from the printed circuit board (for example, back to the capacitor).

Capacitors that are preferred in the present invention are suitable for rapid charging and discharging and effective over an ambient temperature range of at least 0° C. to 40° C., more preferably −20° C. to 50° C. Preferred for the present invention are electric double-layer capacitors (EDLC), also known as supercapacitors or ultracapacitors. Supercapacitors have a relatively high energy density, typically on the order of thousands of times greater than conventional electrolytic capacitors. EDLCs also have a much higher power density than conventional batteries or fuel cells of comparable size. Examples of EDLC capacitors that are commercially available are those marketed by Maxwell Technologies: for example, the PC10 series (2.5V DC, 10 F), HC series (2.7V DC, 5 F-150 F), and D Cell® series (2.7V, 310 F or 350 F). Nichicon (JP) markets the EVer CAP brand of EDLC with rated voltages of 2.5 VDC and 2.7 VDC, and capacitances from about 0.47 F to 4000 F. When selecting a capacitor for use in the present invention, the most important factors are rated capacitance, rated voltage and size of the capacitor.

Regarding size, preferably, a capacitor will be on not much larger or about the size of a typical cylindrical cell battery, such as are presently used in electronic cosmetic devices. More preferably, a capacitor will be about the size of a button battery, such as are often used in hearing aids.

Regarding capacitance, the capacitance of a capacitor that is suitable for use in an electronic personal care device that is to be used with the docking station compact as herein described, is from about 1 to about 200 Farad (F); more preferably, from about 10 F to about 100 F; even more preferably from about 20 F to about 50 F; and most preferably from about 30 F to about 40 F.

Regarding voltage, preferably, the rated voltage of the capacitor is from about 1.5 VDC to about 9 VDC, more preferably, from about 2 VDC to about 6 VDC, more preferably from about 2.5 VDC to about 3.5 VDC.

We have discovered that such capacitors are able to provide sufficient power for at least one intended use of a device according to the present invention, whether the power is used to heat an applicator, heat a product, vibrate an applicator, rotate an applicator, shine a light, or various other purposes related to personal care treatment, especially when the loaded circuit includes a voltage regulator. Capacitors meeting the specifications defined above, can be charged or recharged within the time frames described above. Unlike a battery, the capacitor will outlast the personal care device, reducing waste.

Two Types of Electric Circuits

A fast charging, capacitor-powered personal care device according to the present invention has two types of electric circuits, at least one of each type. A first circuit includes an electric load that drains power from the capacitor when current is flowing through the load. For example, this could be a heating circuit or a circuit that includes a motor for creating vibration, or a lighting circuit, or a cooling circuit that has a heat extraction portion, etc. The first circuit (which we call a loaded circuit) also includes a switch (5*c*), that is capable of interrupting the flow of current between the capacitor and the PCB. When the switch is in a closed state, power is drained from the capacitor (5) and current flows through the loaded circuit. When the switch is in an opened state, power is not drained from the capacitor, and current does not flow through the loaded circuit. Preferably, the switch is accessible to a user. Preferably the switch is located on an outer surface of the device. All manner of switches known in the electronic arts may be useful in various embodiments of the present invention. Some non-limiting examples include: toggle switches, rocker switches, sliders, buttons, rotating knobs, touch activation surfaces, magnetic switches and light activated switches. Also, multi-position switches or slider switches may be useful if the electric load is capable of multiple output levels. A manual switch may be located on the handle, either on the side wall or on the end of the handle, where it is directly accessible. Optionally, when a switch, such as a button, is located on the handle, a cap may be provided that fits over the button. The cap may serve to hide the button for aesthetic reasons or it may protect the button from being switched on unintentionally, while being carried in a purse, for example.

A generic description of one embodiment of a loaded circuit is as follows. Closing switch (5*c*) completes the loaded circuit. Electricity flows from a negative terminal of the capacitor (5), through switch (5*c*), along conductor (5*a*) until it reaches PCB terminal (8*d*). The circuit through the printed circuit board has been described above. Eventually, the current flows out of PCB terminal (8*e*), along conductor (5*b*), and eventually to a positive terminal of the capacitor. Above, we have described the loaded circuit as comprising a printed circuit board and various elements of a sophisticated electric circuit. This is preferred, but not required. A fast charging, capacitor powered personal care device according to the present invention could have a very simple load circuit, such as wire conductors that carry current to and from the capacitor and a load (i.e. coil heating element, motor, LED, etc). Such devices, without a printed circuit board, would still benefit from the use of a fast charging capacitor.

A second circuit is a recharging circuit. The capacitor is able to establish electrical contact to a power reservoir for recharging the capacitor, and the recharging circuit is only completed when the device is accessing the power reservoir. Generally, the power reservoir will be external to the device, and a connection may have to be made to complete the recharging circuit. The connection may be physical contact or induction type. In general, physical contact power connections are formed as two mating connectors, a male (or plug) and a female (jack or port). Connectors of either type may be provided on any surface of the device that is conveniently accessible. Various types of DC power connectors known in the electronic arts, for example, banana, TRS, RCA, and EIAJ. This recitation of connector types is not exhaustive, and other types of connectors, now known or to be developed, may also be useful in the present invention.

A generic description of one embodiment of a recharging circuit is as follows. When a male-type electrical connector (9*a*) is inserted into port opening (4*i*), the male connector is guided into a complimentary electrical port (5*e*), which establishes electrical contact between the external power reservoir and the capacitor (5), such that the negative plate of the capacitor can receive and store electric charge. At the same time, a positive plate of the capacitor discharges into a conductor that leads back to power reservoir. When the capacitor is full, flow of current stops. When charging is completed, the male-type connector can be removed from port opening (4*i*). With the fast recharging capacitors herein contemplated, recharging may take 5 minutes or less, preferably 3 minutes of less, more preferably 2 minutes or less, and even more preferably one minute or less. The recharging circuit may optionally include a switch, such that actual charging only occurs when the switch is closed. Optionally, the recharging circuit may include one or more indicator lights that signal one or more conditions of the recharging. For example, there may be a light that indicates when charging is occurring or that indicates the degree of charge on the capacitor or that indicates that charging has stopped.

Figure 12:
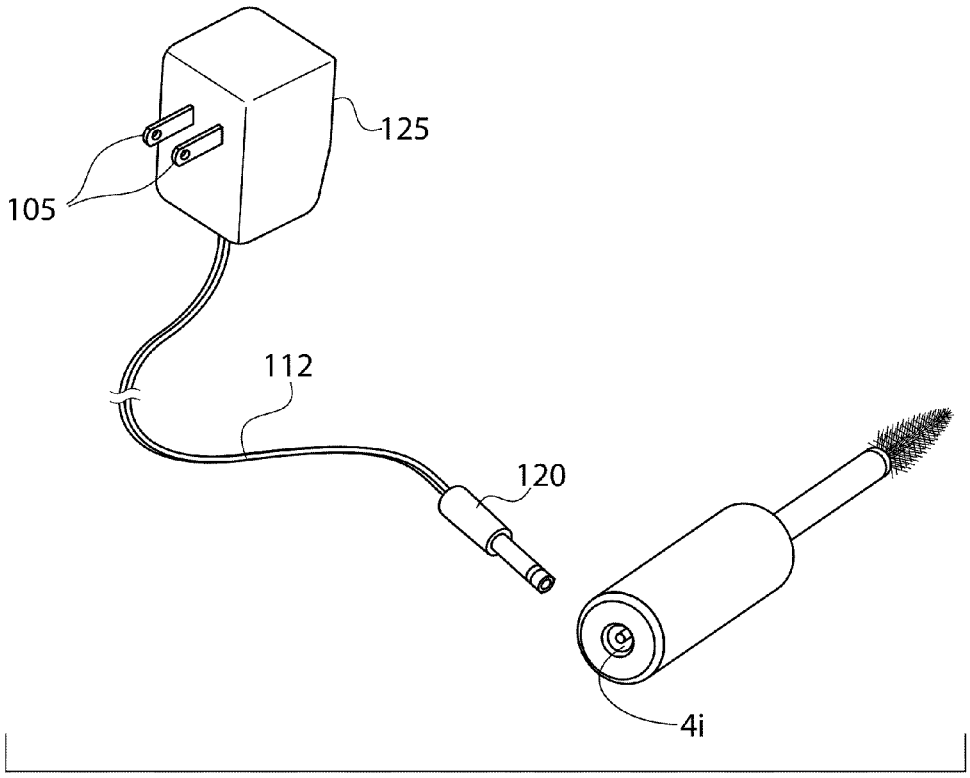
FIG. 12 shows an AC-DC adapter that may be used to recharge a capacitor powered personal care device.

We have described personal care devices that use a rechargeable capacitor. As described, an electrical connector is provided for establishing electrical contact to an external power reservoir. The connector on the applicator interfaces with a mated electrical connector. The mated connector may be part of a conductor cable that leads to a power reservoir, or that may be connected to a power reservoir. In FIG. 12 for example, regular plug (105) of cable (112) connects to ordinary residential electrical power; AC to DC converter (125) transforms to voltage to a DC voltage and current that is appropriate for the capacitor, which may be connected through mating connector (120). Alternatively, the mated connector may be part of a charging base or docking station. Optionally, but preferred, a capacitor powered personal care device, according to the present invention, is recharged through a docking station that is able to securely hold the device and facilitate completion of the recharging circuit. In this case, the docking station comprises a portion of the completed recharging circuit, and may act as a voltage transformer. The base receives electrical power from a convenient source, such as a residential wall outlet or a battery. The base may transform the voltage to a level that is appropriate to the manufacturer's specifications for the capacitor (5), and sends the converted power on to the capacitor.

Figure 10A:
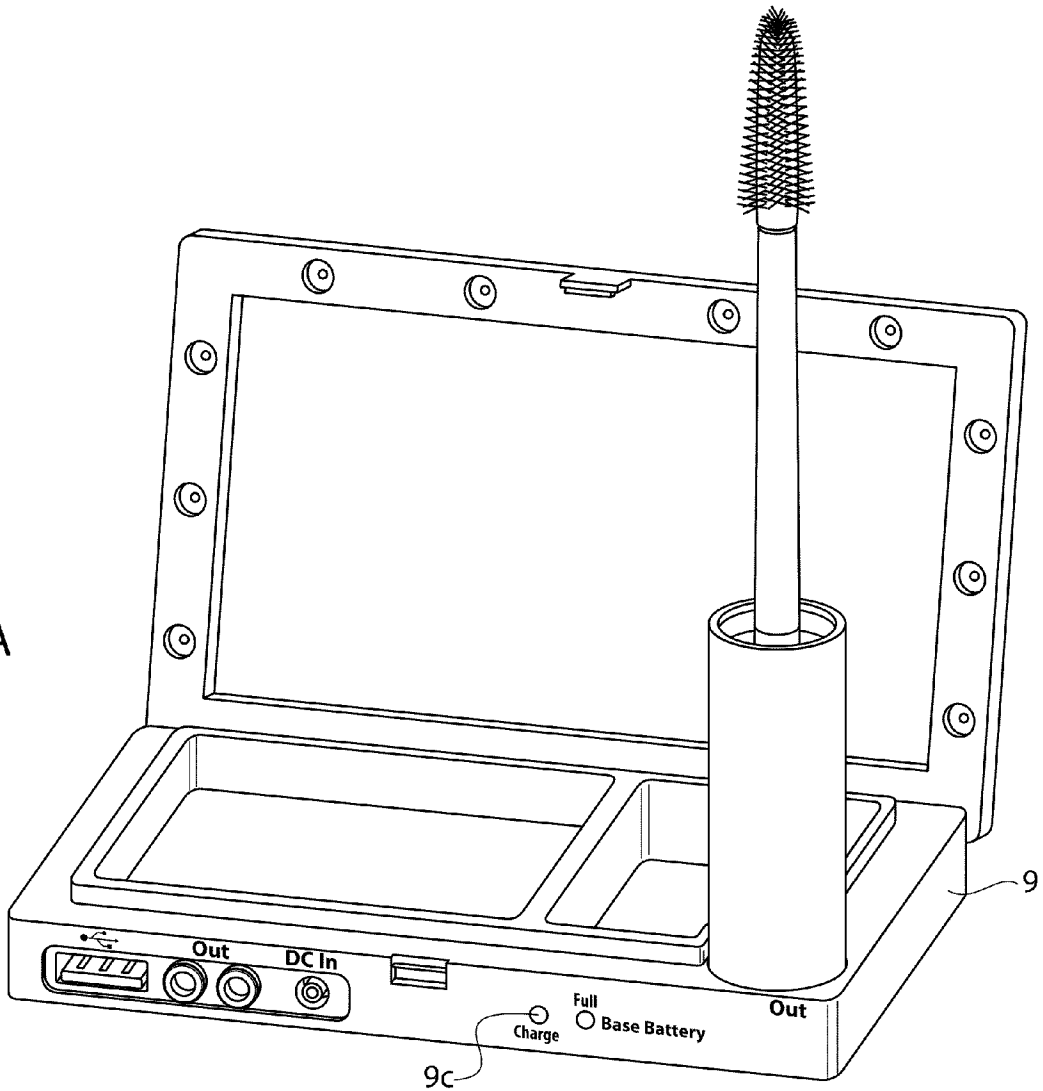
FIGS. 10*a* and 10*b* show a capacitor powered cosmetic device being recharged in a docking station.
Figure 10B:
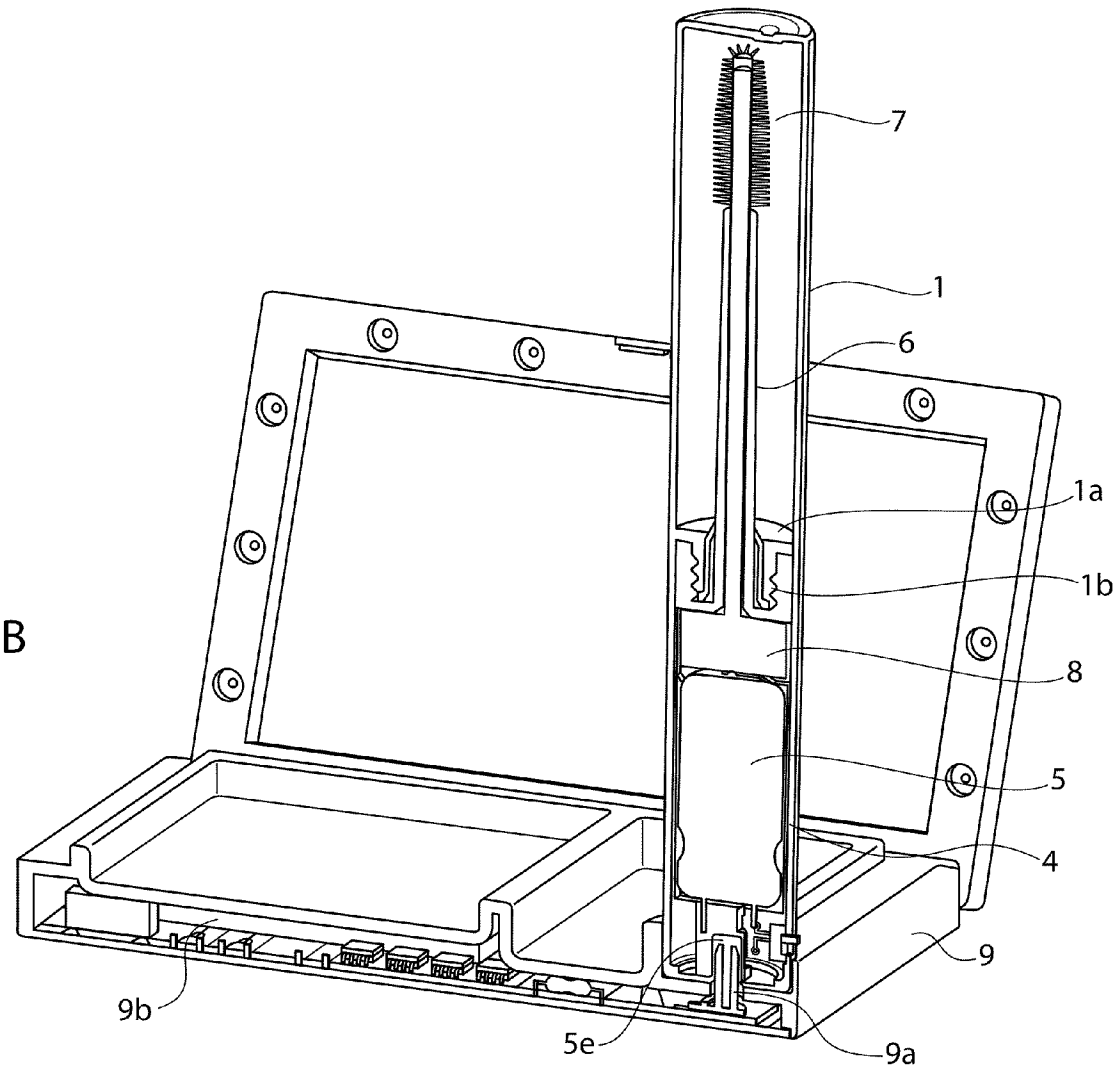
Figure 11:
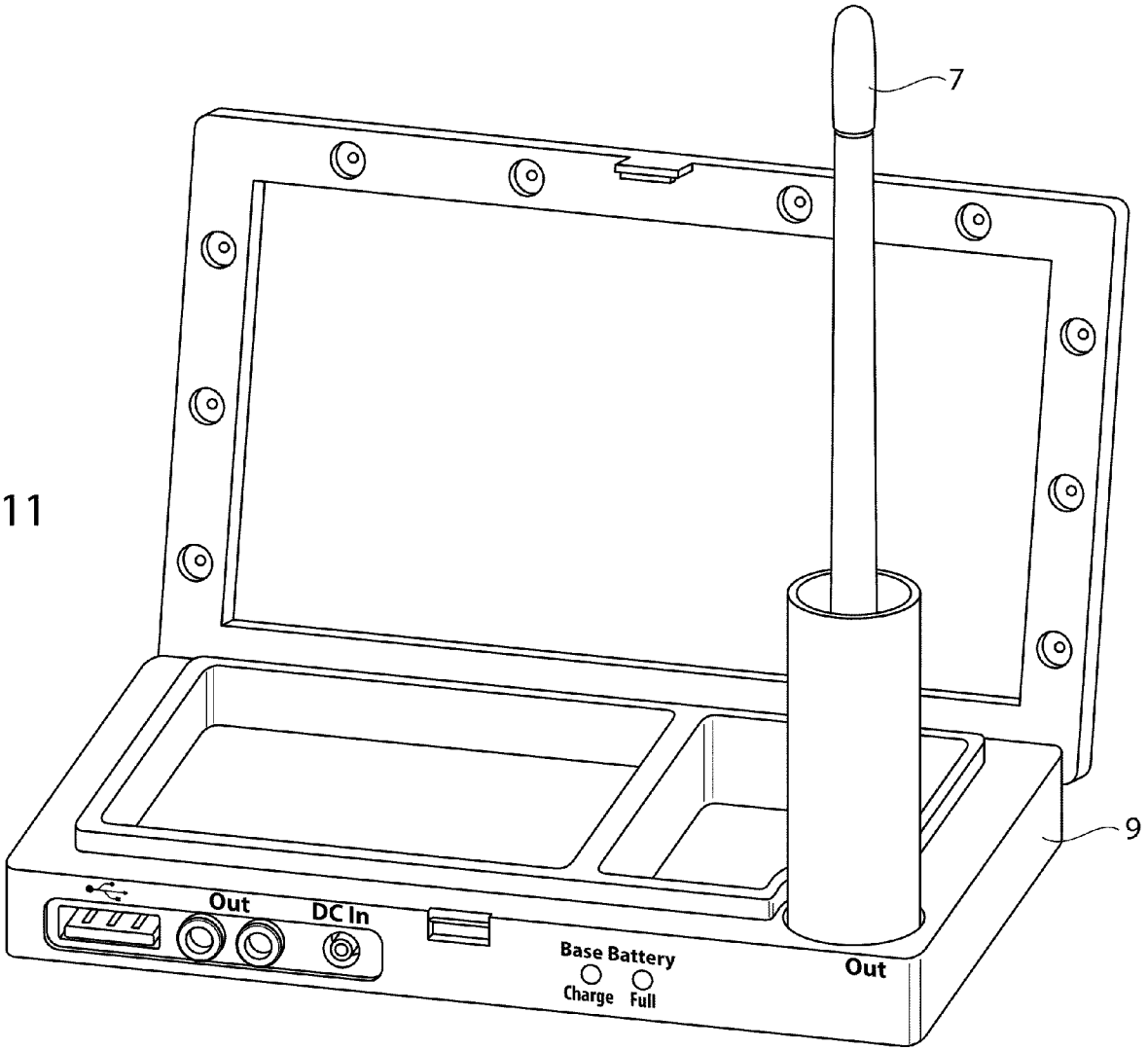
FIG. 11 shows a capacitor powered doe-footed lip product applicator being recharged in a recharging base/docking station.

One embodiment of a capacitor powered personal care device sitting in a docking station is shown in FIGS. 10*a* and 10*b*. FIG. 10*a* is a perspective view of a heating mascara applicator being recharged in a docking station (9), which is implemented as a cosmetic compact. FIG. 10*b* is a similar view shown in cross section. The docking station compact has a battery (9*b*). The battery has sufficient capacity to recharge the capacitor (5). When the handle (4) of the heating mascara applicator is inserted into a recess provided in the docking station compact, the applicator stands securely in place. At the same time, a male-type power connector (9*a*) is inserted through port opening (4*i*) and into complimentary electrical port (5*e*). At that point the recharging circuit is complete, and the capacitor is recharged. In several seconds or minutes, when recharging is complete, an indicator light (9*c*) on the base may light to indicate that recharging is complete. The applicator can be removed from the recharger compact, and used by a consumer. The implementation of the recharging base as a cosmetic compact is convenient, but not required. The recharging base may assume various shapes and sizes, and provide an array of auxiliary functions. FIG. 11 shows a doe-footed applicator being recharged in the base.

Unlike some prior art electronic cosmetic devices, the capacitor (5) is not able to last the entire lifetime of a typical full size (i.e. non-promotional size) commercial product container, without being recharged. "Lifetime" of a container refers to the time that it takes for a user to extract and apply as much product from the container as possible, in normal, intended use. For example, a typical full size mascara container, useful in the present invention, may be filled in the filling plant, with at least 4 g of product, preferably at least 6 g of product, more preferably at least 8 g of product, and most preferably at least 10 g of product. The capacitor of the present invention, if used in a heated device, will not last the entire lifetime of such a container. However, each time a capacitor powered personal care device according to the present invention is activated (or "turned on"), it is preferable if the capacitor (5) is able to provide, by itself, sufficient energy to complete at least one treatment or product application with satisfactory results, as each situation may dictate. For example, it is preferable if the capacitor (5) is able to provide, by itself, sufficient energy to increase the temperature of a personal care product from an ambient temperature to a product application temperature in 2 minutes or less, and hold it there long enough to complete the treatment or makeup. The increase in temperature may be about 10° C. or more, preferably about 20° C. or more, more preferably about 30° C. or more. For example, ambient temperature may be 20° C. to 25° C., and product application temperature may be 30° C. or greater, preferably 40° C. or greater, more preferably 55° C. or greater. The capacitor can do this at least once, perhaps, more than once, but not much more. Despite the short discharge cycle compared to a battery, the advantages of this invention are several, as we now discuss.

While various electronic personal care devices are known, it is common for those articles to be powered by a battery. When the battery is depleted, it must be replaced of recharged. If the depleted battery can be recharged, it may take several hours to recharge the battery, as is typical of the recharging operation. Also, there is a limit to the number of times a battery can be recharged. Also, batteries add a lot of weight to the device, and take up a lot of space, which may not be desirable. In contrast, an electronic personal care device that uses a fast charging capacitor is able to overcome several limitations of batteries. First, the capacitor can be charged and recharged within several seconds or minutes. A fully charged capacitor may give only one or a few applications, or only several minutes of use, before it has to be recharged, but many electronic personal care devices are not used for extended periods of time. An application or use may only take several seconds to 2-3 minutes. Also, the recharging is relatively fast, about 10 to 50 times faster than a rechargeable battery, and fast enough to be convenient for many consumers. If a recharging base is battery based and convenient to carry, like the cosmetic compact base described above, then the capacitor can be recharged on the go, away from a stationary power reservoir. Since it can be recharged in minutes or less, the advantage of batteries is greatly diminished. Furthermore, compared to a battery, the capacitor can be recharged indefinitely. Also, the capacitor is relatively light, compared to a battery of comparable size. And, for a given level of power, the capacitor is significantly smaller than a battery. Because of this, a personal care device that utilizes a capacitor as its current source may have more flexibility in its design than a personal care device that uses a battery. Furthermore, unlike many batteries, the capacitor is disposable in the ordinary household waste stream. Furthermore, because it can be charged in seconds or minutes, a personal care device sold with a capacitor does not have to be charged before time. The consumer may perceive no inconvenience if she has to charge the capacitor before first use. If a battery is used, the consumer may net be happy if she has to wait six or eight or twelve hours before first use.

In some aspects, the present invention is a kit comprising an electronic personal care device that comprises a fast charging capacitor, wherein the device has a well defined or intended use, and a set of low dose containers that hold no more than a limited number of doses of product. The number of doses in low dose container may be fewer than 20, preferably fewer than 10, more preferably fewer than 5, most preferably, exactly 1 or 2 doses. Depending on the type of personal care product and the evacuation profile of the low dose container, the amount of product that may be extracted form a low does container by a device according to the present invention, or for use with a device according to the present invention, may be from about 0.5 g to about 20 g; preferably from about 0.5 g to about 10 g; more preferably from about 0.5 g to about 5 g; even more preferably from about 0.5 g to about 1 g; likewise from about 0.25 g to about 0.75 g. Preferably, the number of intended uses that may be completed by a fully charged capacitor, is coordinated with the number of doses in each container. For example, the device is a vibrating lipstick applicator, the intended use is applying lipstick to two lips (one set of lips), each container holds enough product for completing exactly 2 applications to a set of lips, and will be discarded thereafter; the capacitor is fully charged with enough energy to complete 4 lipstick applications, but not more. In this example, on average, after a user has gone through 2 containers of lipstick (i.e. applied lipstick 4 times), she will have to recharge the device. Or, for example, the device is a heating mascara applicator, the intended use is applying mascara to the eyelashes of two eyes; each container holds enough product for completing exactly 1 application of two eyes, and will be discarded thereafter; the capacitor is fully charged with enough energy to complete 1 heated mascara application, but not more. In this example, after each mascara application, the capacitor must be recharged. Or, said another way, each time a user opens a new container, the applicator should be recharged.

Other examples involve products that suffer some undesirable alteration as a result of being heated. For example, water-based products, like some mascaras, may experience dry-out when heated. Products that comprise solvents other than water may experience dry-out to a more or less degree. Products that comprise wax or some types of plastic may form crystals when heated or otherwise have their rheology profile negatively affected. Up to now, all or some of these problems have hindered or prevented heated versions of these products from coming to the market. To get around this problem, it would be convenient to supply the mascara in a kit comprising a set of low dose containers that hold no more than some number of doses of mascara, along with an applicator that comprises a handle, a heat generating portion that is able to be immersed in the mascara, and a fast charging power capacitor housed within the handle. In one embodiment, when fully charged, the capacitor is able to provide enough electric current to the heat generating portion to allow a user to use up no more than exactly one container. This is not a drawback, because that is all she wanted to use. The rest of the mascara remains sealed in other containers and is not subject to drying out by the heating applicator. While this could be done with a battery powered device, the disadvantages of batteries will often make a capacitor powered device more attractive. In fact, any time that low dose packaging is provided, a personal care device according to the present invention may be useful to avoid the disadvantages of batteries and other types of power sources.

In some aspects, the present invention is a an electronic personal care device that comprises a fast charging capacitor, wherein the device has a well defined or intended use, that is not specifically tied to a personal care composition. The capacitor energy is sufficient for completing no more than a limited number of intended uses, for example, no more than 10 uses, or no more than 5 uses, or no more than 2 uses, or no more than exactly 1 use. For example, the device could be a light treatment for skin acne, providing one or more doses of light centered around specific wavelengths. Such a device would still benefit from using fast charging capacitor, when, for example, one wants to avoid the disadvantages of batteries.

Although we have mostly discussed a heated mascara applicator, the principles described herein can be implemented in all sorts of personal care devices, for use with or without an associated product. The capacitor power can be used to produce heat, cold, vibration, sound, and light. It can also be used to power a display device, or process digital information. Any function that requires only several minutes of power may be implemented in a personal care device having fast charging capacitor as described herein.

One example of a cooling personal care device is based on a thermoelectric effect known as the Peltier effect. To achieve this effect, an electric current flows across a junction from a first metal to a second, dissimilar metal. Discontinuities at the junction cause heat to be removed from the second metal (thus cooling it), and transferred, against a temperature gradient, to the first metal (thus heating it). If the direction of current is reversed, then the effect is also reversed. Thermoelectric heat pumps based on the Peltier effect are known, and take the form of solid-state devices that transfer heat from one side of the device to the other, heating one side and cooling the other. For example, Peltier devices that are powered from a USB port, and used to cool or heat drinks, are commercially available. A capacitor powered device according to the present may comprise one or more Peltier solid state devices. Power can be supplied by the capacitor, and the circuit may have an on-off switch. Optionally, the circuit may have a temperature sensor, a means of alerting the user when the product has reached a certain temperature, and an automatic shut off capability.

What we claim is:

1. A handheld personal care device comprising:

a fast charging capacitor having a capacitance of about 1 to about 200 F and wherein the voltage of the capacitor when fully charged is from about 1.5 to about 9 volts DC;

at least one loaded circuit that comprises a switch, and a heat generating portion that is able to drain power from the capacitor when the switch is in a closed state, but not when the switch is in the opened state;

wherein the heat generating portion comprises a bank of fixed value resistors electronically arranged in series, parallel, or any combination thereof;

a system for monitoring and maintaining an output voltage of the capacitor;

a recharging circuit that is capable of establishing electrical contact to an external power reservoir, such that the capacitor is recharged by the external power reservoir when current is flowing in the recharging circuit.

2. A device of claim 1 wherein when current is flowing in the recharging circuit, the capacitor is fully recharged in 5 minutes or less.

3. A device according to claim 1 further comprising an applicator head that can hold a product on its outer surface, and wherein the capacitor can provide sufficient energy to the heat generating portion to increase the temperature of a mascara product sitting on the outer surface of the applicator head, from an ambient temperature to a product application temperature, in two minutes or less.

4. A handheld device according to claim 3 wherein temperature increase is 10° C. or more.

5. A handheld device according to claim 3 further comprising a container that is able to hold an amount of a personal care product that can be withdrawn by the applicator head.

6. A device according to claim 5 wherein the personal care product is water based mascara.

7. The device according to claim 3 wherein the applicator head is a molded brush that comprises a hollow, elastomeric sleeve that fits over the heat generating portion.

8. The device of claim 7 wherein the sleeve comprises one or more thermoplastic elastomers.

9. The device of claim 1 wherein the fixed value resistors have rated resistances from 1 to 10 ohms.

10. The device of claim 9 wherein the resistive heating elements are metal oxide thick film, chip resistors, the largest dimension of which is 2.0 mm or less.

11. The device of claim 9 wherein the resistive heating elements are discrete dots of a metal oxide thick film, provided as a silk screen deposit on the printed circuit board.

12. The device of claim 1 further comprising a handle that houses the capacitor.

13. The device of claim 1 wherein the loaded circuit includes a voltage divider circuit and a thermistor.

14. The device of claim 13 which further comprises an operational amplifier and an N-channel MOSFET switch.

15. A kit comprising a device according to claim 1, and a set of low dose containers that hold fewer than 20 doses of product and less than about 20 g of product, wherein when the capacitor is fully charged, the capacitor is able to provide enough electric current to allow a user to use up no more than exactly one container.

* * * * *